US007491162B2

(12) United States Patent
Penn et al.

(10) Patent No.: US 7,491,162 B2
(45) Date of Patent: Feb. 17, 2009

(54) DAILY ORGANIZER

(76) Inventors: Emily Penn, 25 Central Park West, 16I, New York, NY (US) 10023; Alison Schneiderman, 25 Central Park West, 7E, New York, NY (US) 10023

( * ) Notice: Subject to any disclaimer, the term of this patent is extended or adjusted under 35 U.S.C. 154(b) by 211 days.

(21) Appl. No.: 11/382,404

(22) Filed: May 9, 2006

(65) Prior Publication Data

US 2007/0025808 A1 Feb. 1, 2007

Related U.S. Application Data

(60) Provisional application No. 60/678,981, filed on May 9, 2005.

(51) Int. Cl.

| | |
|---|---|
| ***B31B 1/00*** | (2006.01) |
| ***B31B 19/00*** | (2006.01) |
| ***B31B 21/00*** | (2006.01) |
| ***B31B 23/00*** | (2006.01) |
| ***B31B 25/00*** | (2006.01) |
| ***B31B 27/00*** | (2006.01) |
| ***B31B 29/00*** | (2006.01) |
| ***B31B 31/00*** | (2006.01) |
| ***B31B 33/00*** | (2006.01) |
| ***B31B 37/00*** | (2006.01) |
| ***B31B 39/00*** | (2006.01) |
| ***B31B 49/04*** | (2006.01) |

(52) U.S. Cl. ..... 493/186; 229/69; 229/67.1; 229/67.3

(58) Field of Classification Search ..... 402/57, 402/73, 79, 80 R, 80 P; 283/36–42; D19/26–27; 40/359; 229/67.1, 67.3, 69; 493/186, 243, 493/254

See application file for complete search history.

(56) References Cited

U.S. PATENT DOCUMENTS

| | | | | |
|---|---|---|---|---|
| 81,564 | A * | 8/1868 | Matthews | 428/332 |
| 182,564 | A | 9/1876 | Davis | |
| 590,765 | A | 9/1897 | Miller | |
| 983,964 | A | 2/1911 | White | |
| 1,219,544 | A * | 3/1917 | Gareis | 281/27.1 |
| 1,495,953 | A | 5/1924 | Dick | |
| 1,531,429 | A | 3/1925 | Weis | |
| 1,574,838 | A * | 3/1926 | Moore | 402/70 |
| 1,575,115 | A | 3/1926 | Hanser | |
| 1,760,069 | A | 5/1930 | Kennedy | |
| 2,330,402 | A * | 9/1943 | Winokar | 229/72 |
| 2,776,085 | A * | 1/1957 | Furey | 229/69 |

(Continued)

*Primary Examiner*—Dana Ross
*Assistant Examiner*—Kyle Grabowski
(74) *Attorney, Agent, or Firm*—Carter, DeLuca, Farrell & Schmidt LLP.

(57) ABSTRACT

An organizer which includes a plurality of holders for holding recording media such as disposable cards. A first holder has a first upper edge and a second holder has a second upper edge and a second lower edge. The second holder is disposed behind the first holder and attached thereto at the second lower edge so that the second upper edge is above the first upper edge. The first holder and second holder are movable with respect to each other about the second lower edge. A method for organizing information includes recording information on a plurality of items of a disposable recording medium in accordance with categories of information, each item corresponding to one category and one subcategory; and arranging those items in the organizer including removing and/or inserting the items.

4 Claims, 18 Drawing Sheets

U.S. PATENT DOCUMENTS 3,668,979 A * 6/1972 Cariven ..... 493/384
3,680,969 A * 8/1972 Gorman ..... 402/3
3,839,809 A 10/1974 Casas et al.
3,885,841 A * 5/1975 Stevens ..... 312/183
4,004,690 A * 1/1977 Giarritta ..... 206/425
4,330,951 A 5/1982 Hauer
4,441,270 A * 4/1984 Crowell et al. ..... 40/534
4,451,067 A 5/1984 Williams
4,577,889 A * 3/1986 Schulz ..... 281/15.1
4,583,764 A * 4/1986 Steffen ..... 281/31
4,589,544 A * 5/1986 Schweinsberg ..... 206/740
4,629,070 A * 12/1986 Roberg ..... 206/455
4,639,157 A * 1/1987 Herzfeld ..... 402/19
4,706,396 A * 11/1987 Nomura ..... 40/124.2
5,059,052 A 10/1991 Casper
5,222,764 A 6/1993 Dyer
5,333,908 A 8/1994 Dorney et al.
5,586,829 A * 12/1996 Schwartz ..... 402/79
5,620,271 A * 4/1997 Bergh et al. ..... 402/79
5,989,034 A 11/1999 Ninomiya et al.
6,039,355 A 3/2000 Durand
6,135,662 A 10/2000 Bakke et al.
6,168,340 B1 * 1/2001 Lehmann et al. ..... 402/79
6,217,074 B1 4/2001 Conley, Jr.
6,231,943 B1 5/2001 Nijboer et al.
6,652,178 B2 11/2003 Walton
6,659,336 B2 * 12/2003 Brennan ..... 229/67.1
6,986,422 B2 1/2006 Boatwright

* cited by examiner

DAILY ORGANIZER

CROSS-REFERENCE TO RELATED APPLICATION

This application claims the benefit of U.S. Provisional Application No. 60/678,981, filed May 9, 2005.

FIELD OF THE INVENTION

This invention relates to daily organizers, and more particularly to a combination of calendar and organizer having several sections enabling a user to manage time and activities according to different topics.

BACKGROUND OF THE INVENTION

People are required to manage many pieces of information in the course of a typical day, relating to appointments, errands, projects and responsibilities. In addition, a person has goals and other personal matters which need to be incorporated into the planning of one's day in order for them to be realized. Besides the recurring and/or ordinary pieces of information an individual must track and record (which can clutter a person's mind or workplace), it is necessary to make note of new and important ideas lest they be forgotten. In general, having to remember a great many pieces of information tends to make a person feel overwhelmed and therefore, less productive and creative.

A number of personal organizers (often also called daily organizers or day planners) are available which provide specific places to write down goals, appointments, to-do lists, etc. The effectiveness of an organizer depends upon its ease of use, including its portability and the user's ability to put all needed information in one place, so that information may be accessed efficiently and in an organized manner.

At present most paper-based personal organizers use individual sheets of paper held in ring binders or bound books, which do not allow for easy disposal of information no longer needed. Although the format of a binder allows the user to select various topics for recording information, a binder often becomes a vehicle for dated information and an array of random notes. Similarly, bound books require the user to sort through old and unneeded information.

Portable or pocket-sized organizers available today are suitable for carrying a limited amount of information, not all of which may be easily accessed. One such pocket-sized portfolio organizer is described in U.S. Pat. No. 5,059,052 to Casper. This patent describes a portfolio system to hold various materials, such as a passport and currency, for the business person. It also contains a pocket for three information cards which are tri-folded. This invention is not designed for an individual's personal use (that is, makes no provision for tracking one's personal responsibilities, activities and goals), and does not use flat cards. Another pocket organizer system, described in U.S. Pat. No. 5,222,764 to Dyer, uses a pocket-sized container having folded sheets of paper for recording appointments, addresses and the like. A user of this system is required to unfold and fold the various sheets to consult or update the information.

Organizers including loose-leaf binders are described in U.S. Pat. No. 5,333,908 to Dorney et al.; U.S. Pat. No. 6,039,355 to Durand; and U.S. Pat. No. 4,451,067 to Williams. These organizers feature tabbed sections for separating various types of information. A user of such a ring binder may be reluctant to use these sections for various everyday purposes because their format appears too permanent. Some sections (e.g. at the rear of the binder) are not readily visible. Many users therefore will write notes and shopping lists, for example, on cards or scraps of paper and then put them in random places, instead of actually writing on the pages of the organizer book. A card file, particularly one with tabbed dividers such as described in U.S. Pat. No. 1,531,429 to Weis, may serve as a convenient, reusable calendar and reminder system if one is at one's desk. Such a file generally is intended for desktop use and lacks portability.

There remains a need for a daily organizer which is portable, permits the user to carry only information that is currently needed, and provides quick visual access to different types of information. In particular, there is a need for an organizer which allows the user to easily take out and insert individual cards containing specific information made of various paper weights.

SUMMARY OF THE INVENTION

The present invention addresses the above-described need by providing an organizer which includes a plurality of holders for holding recording media, and in which a first holder has a first upper edge and a second holder has a second upper edge and a second lower edge. The second holder is located behind the first holder and attached thereto at the second lower edge so that the second upper edge is above the first upper edge. The first holder and second holder are movable with respect to each other about the second lower edge.

According to another aspect of the invention, an organizer includes a plurality of sections of envelopes, each section having two envelopes characterized as a front envelope and a rear envelope each having a lower edge and an upper edge. The lower edge of the rear envelope is attached to a rear surface of the front envelope at a vertical distance above the lower edge of the front envelope, so that the upper edge of the rear envelope is displaced by that vertical distance above the upper edge of the front envelope; the rear envelope is capable of movement with respect to the front envelope by rotating about the lower edge of the rear envelope. A tab extends from the rear envelope.

According to an additional aspect of the invention, a method is provided for a higher level of organizing, planning, and documenting the information for a person to navigate one's life. This method includes the steps of recording information on a plurality of items of a recording medium in accordance with categories of information, each category including a plurality of subcategories, each said item corresponding to one category and one subcategory therein; and arranging said items in accordance with said categories and subcategories in an organizer such as described just above.

According to a further aspect of the invention, a system is provided for organizing information, comprising a plurality of disposable items of recording media and an organizer including a plurality of sections of envelopes for holding those items. The system may include a set of cards which are labeled in accordance with categories and subcategories of information. The cards are then arranged in accordance with those categories; cards containing unneeded information may be discarded or filed for later reference. Furthermore, this system permits the user to choose categories and subcategories according to individual preferences, so that the organizer is personalized.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals:

DETAILED DESCRIPTION OF EMBODIMENTS OF THE INVENTION

In a first embodiment of an organizer according to the invention, cards are placed in card holders which are arranged in tabbed sections. The card holders (which may be viewed as open envelopes) are grouped in pairs so that each pair of cards is arranged in a two-tier layout. If there are six tabbed sections (corresponding to six categories of information, discussed in detail below), there are a total of twelve card holders, each of which is devoted to a specific topic or type of information. Each card holder has one or more cards which relate to that topic. A card may be removed from the card holder and carried singly, or discarded. It should be noted that the organizer may be refreshed by removing old cards from the card holders and replacing them with new cards. In particular, information that changes daily (e.g. the day's appointments, a grocery list, etc.) may be instantly removed and discarded when no longer needed.

Figure 1:
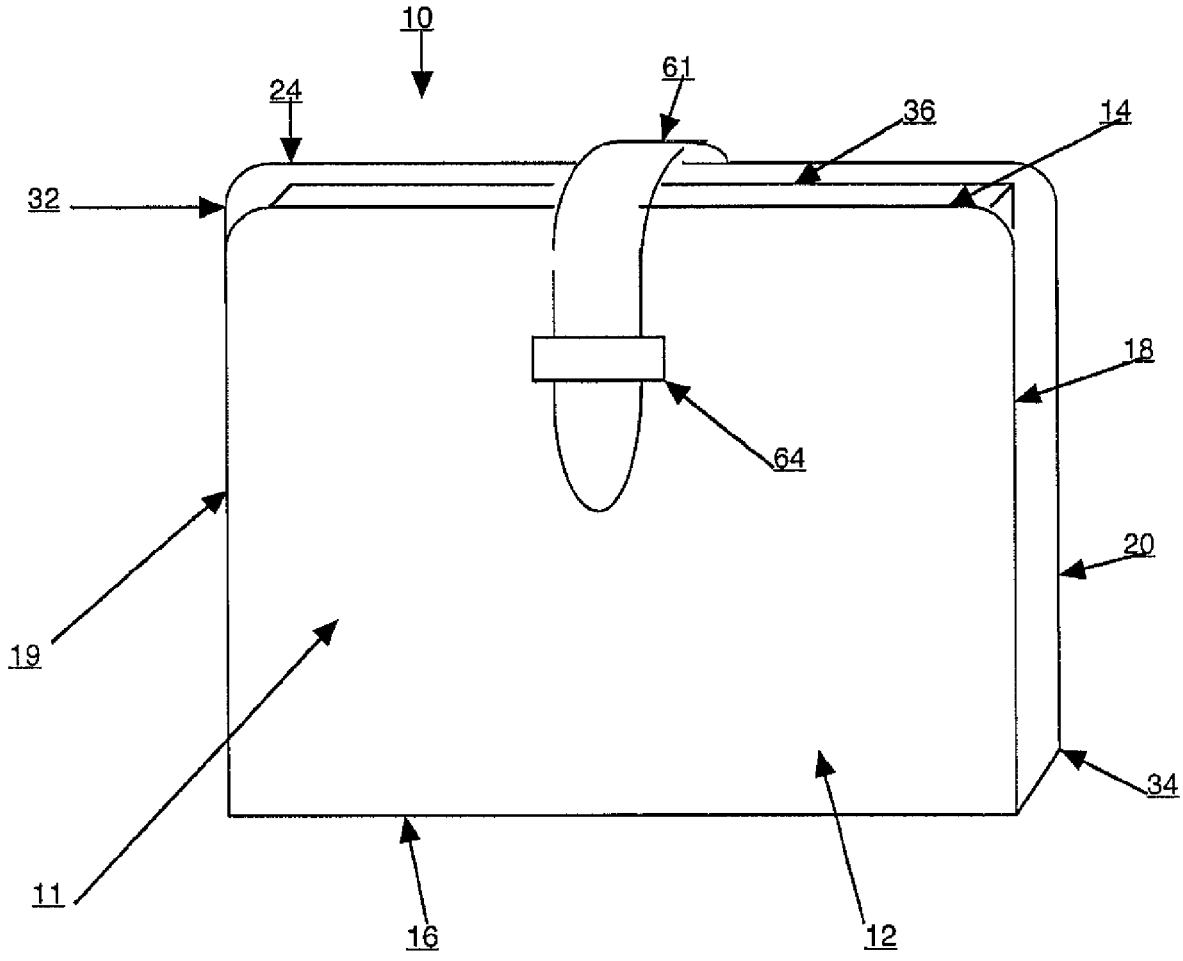
FIG. 1 is a perspective view of the front side of an organizer in accordance with an embodiment of the invention.
Figure 2:
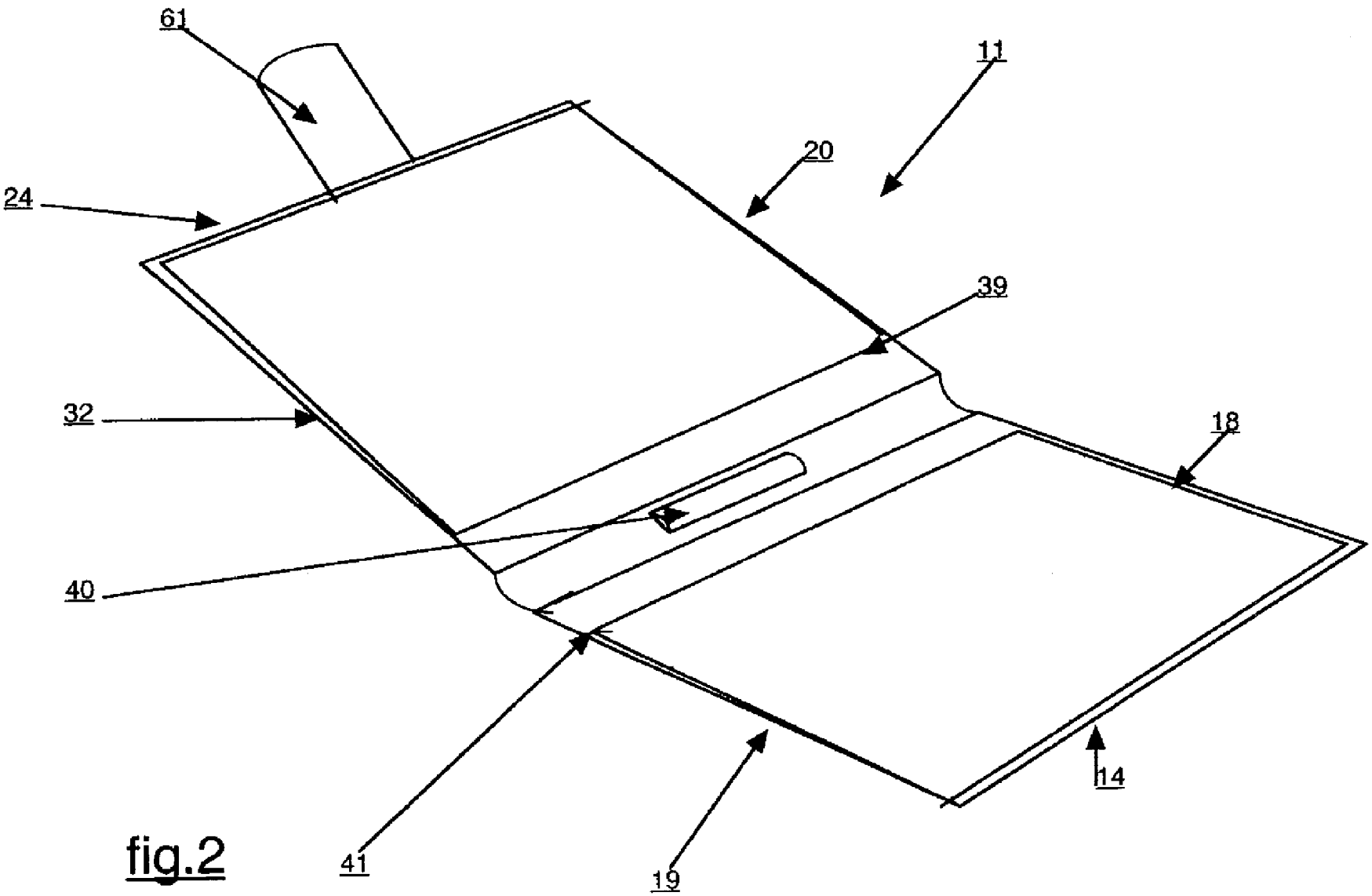
FIG. 2 is a perspective view of the inside of the organizer of FIG. 1.

An exterior view of an organizer 10 embodying the invention is shown in FIG. 1. The exterior case 11 (made of leather, vinyl, fabric, etc.) has a front cover 12 with a top edge 14 and lower edge 16, a front right edge 18, a front left edge 19, a rear right edge 20, a rear left edge 32, a rear top edge 24, and a rear bottom edge 34. A closure flap 61 is held in place by a looped receptacle 64. The interior of the case is shown in FIG. 2. Panels are attached to the upper and lower portions of the case with open edges 39 and 41 respectively, to define pockets into which the card holders and calendar of the organizer may be inserted. In the central or hinge portion of the case, a holder 40 is provided for a writing implement.

Figure 3:
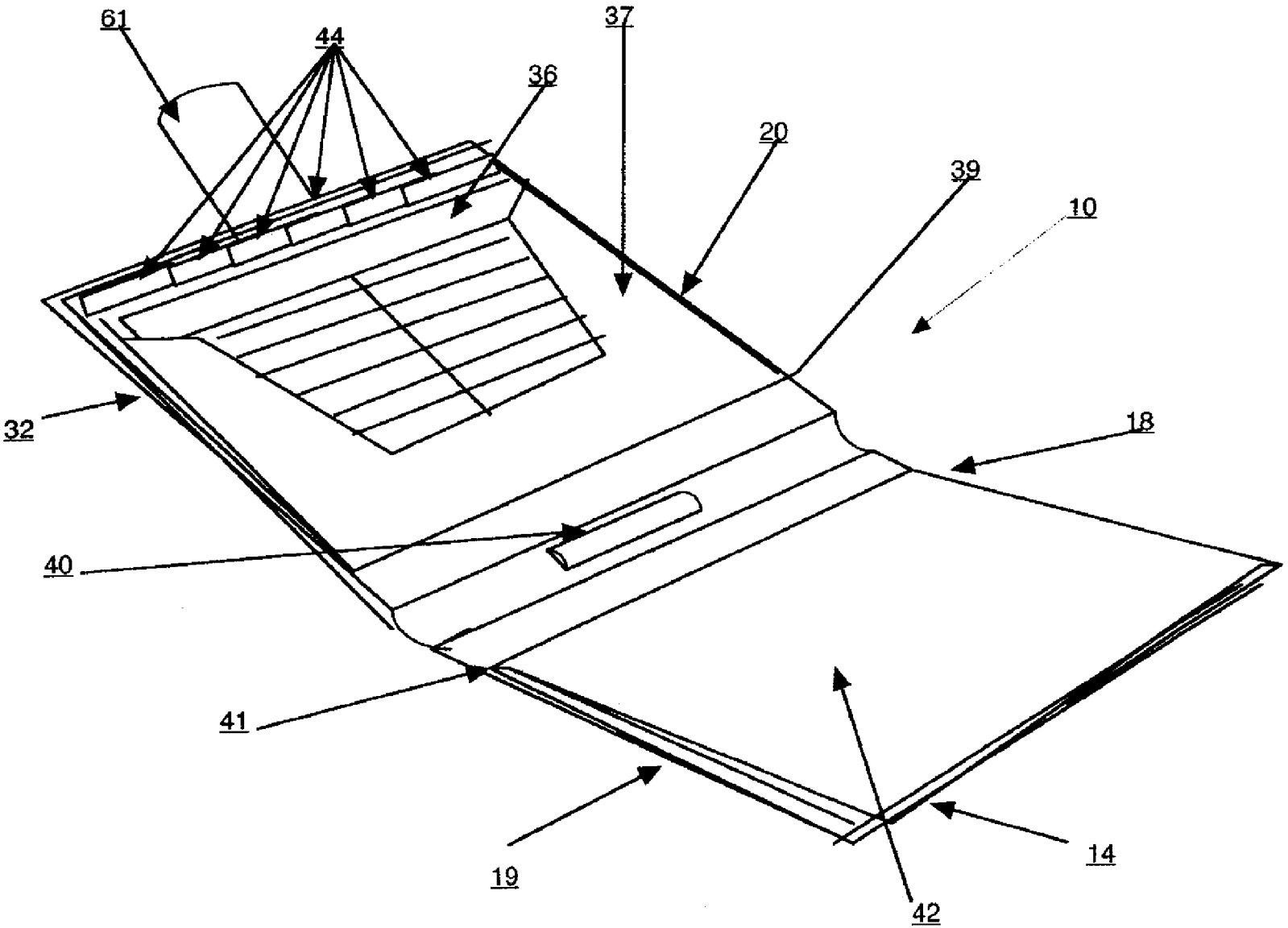
FIG. 3 shows an organizer with card holders and cards inserted therein, in accordance with an embodiment of the invention.

FIG. 3 shows the organizer in the opened case. A calendar 42 is provided in the lower portion. The calendar is preferably paperbound and may have multiple pages; the back cover of the calendar is inserted into the pocket of the lower portion of the case at opening 41. Calendar 42 may be a traditional one-year calendar with a full month visible at a time. Alternatively, the calendar may have a shorter time period (e.g. one month), so that the user inserts a calendar for the current month (and calendars for subsequent months if desired) into the lower portion of the case. An obsolete calendar may easily be removed, discarded or filed.

The card holders (envelopes) 37 of the organizer are bound together (in an arrangement described in detail below) with a tab (not shown) inserted into the pocket of the upper portion of the case at opening 39. Some or all of the envelopes may be marked using tabs 44, as shown schematically in FIG. 3. In this embodiment, there is one tab to mark each section of envelopes, with each section corresponding to a category of information.

Figure 4A:
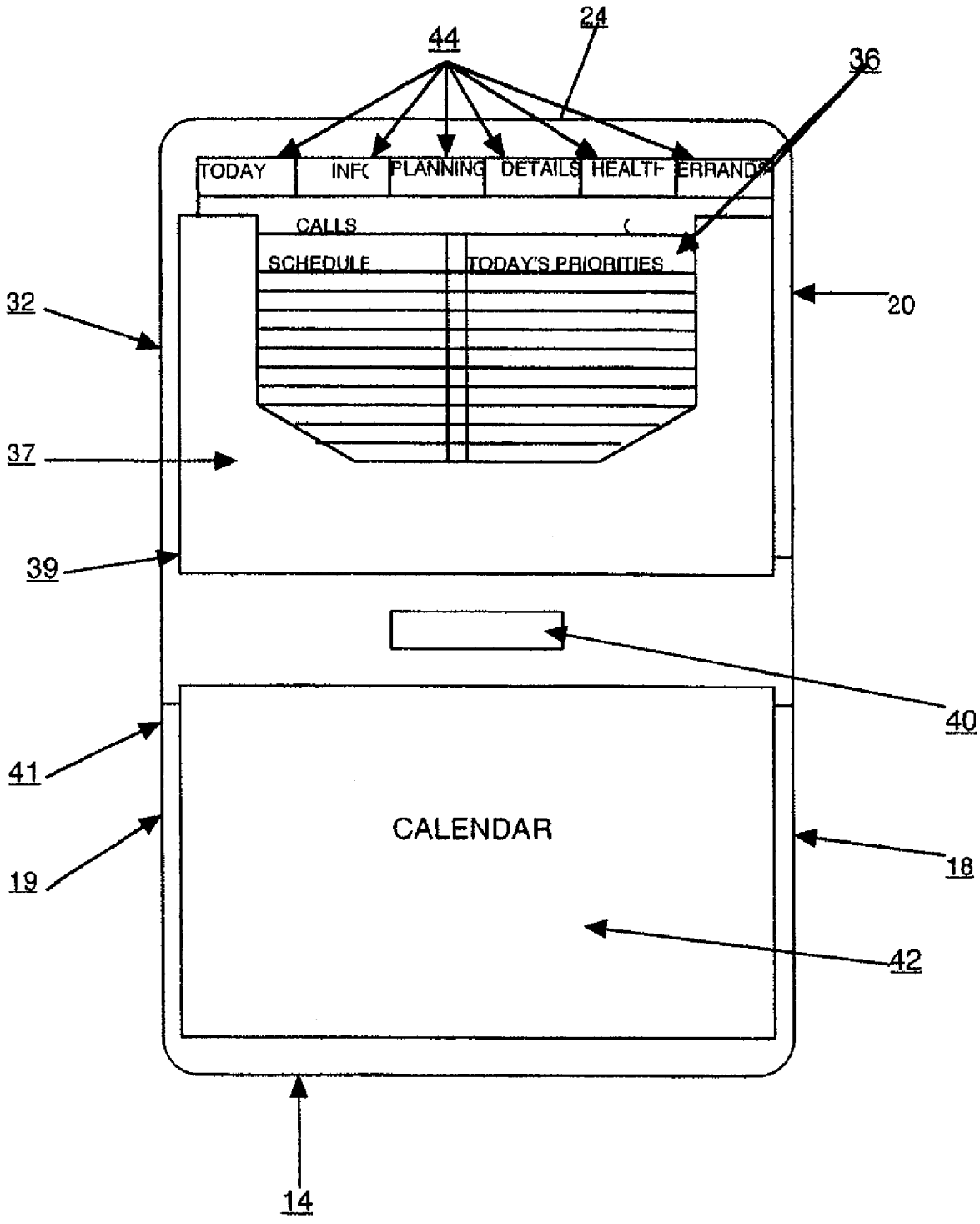
FIG. 4A is a plan view of the inside of an organizer according to an embodiment of the invention, showing details of a calendar and card holder.

FIG. 4A is a plan view of the organizer, showing a typical card 36 in an envelope 37. In this embodiment, card 36 is preprinted with two columns marked "Schedule" and "Today's Priorities." Card 36 is thus intended to show the user's daily appointments schedule; this card is immediately in full view whenever the organizer is opened. The user therefore does not need to open a bound calendar to a specific page to find the day's appointments as in various conventional organizers.

It is noteworthy that another card is visible behind card 36; this card is in a separate envelope (not visible in this Figure) and is preprinted with two columns marked "Calls" and "Online." The envelope holding this card is provided with a tab marked "Today." In this embodiment, six tabs 44 are provided which correspond to the categories Today, Information, Planning, Details, Health and Errands. It will be appreciated that these six category labels are presented as an example. Other categories and/or arrangements of tabs may be used according to individual preferences. A convenient size for the cards and calendar is 4×6 inches, although other sizes may be provided to suit individual users' needs.

The envelopes 37 are preferably heat-sealed vinyl or an equivalent durable, transparent material, but may also be paper or some other material. Envelopes of vinyl may be transparent (clear), translucent or opaque; non-transparent envelopes may be preferred by a user more concerned about privacy than about access or readability of the various cards. Similarly, the cards 36 are preferably of card or text weight stock, and may also be appropriately sized pieces of paper or any material suitable for quickly recording information.

When the organizer is opened, the cards immediately appear face up in the top half of the organizer, and the calendar appears in the lower half. Accordingly, all spaces are used productively, and information is stored in an accessible, meaningful and visually active manner while clutter is avoided. Furthermore, in this embodiment the calendar pages flip up while the envelopes and cards flip down along horizontal edges; the organizer may thus be used with equal facility by both right-handed and left-handed persons.

Figure 4B:
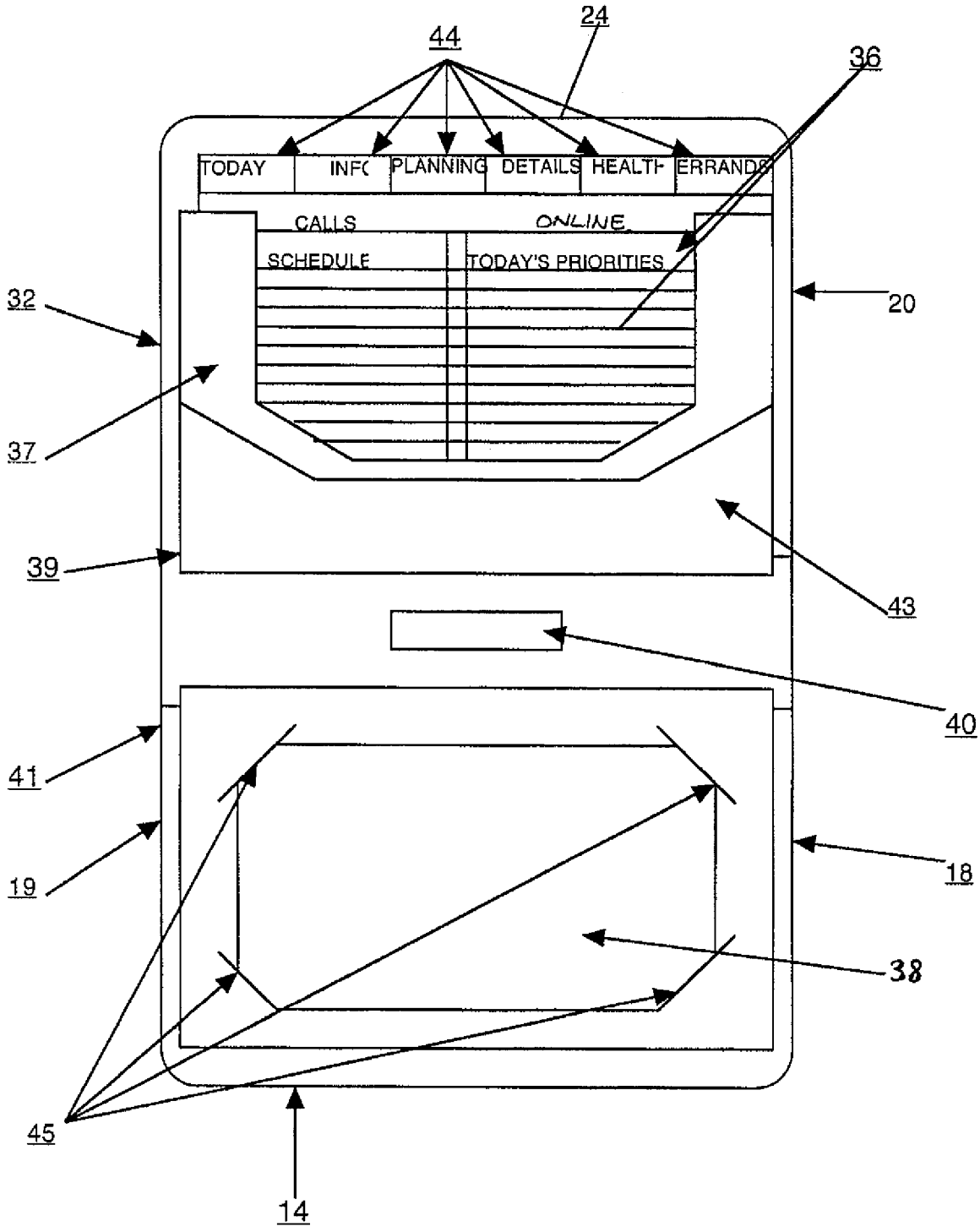
FIG. 4B is a plan view of the inside of an organizer according to a further embodiment of the invention.

An envelope 43, suitable for holding a business card, may be provided on the front cover of envelope 37 as shown in FIG. 4B, without substantially interfering with the visibility of cards 36. Envelope 43 may be the same width as envelope 37 so that envelope 43 may hold a card 36 if desired. In addition, slotted openings 45 may be provided in the cover of the calendar for holding a note card 38. Note card 38 is immediately visible whenever the organizer is opened. A user may make quick notes on this card and transfer the information later to the relevant section in the upper half of the organizer.

Figure 5:
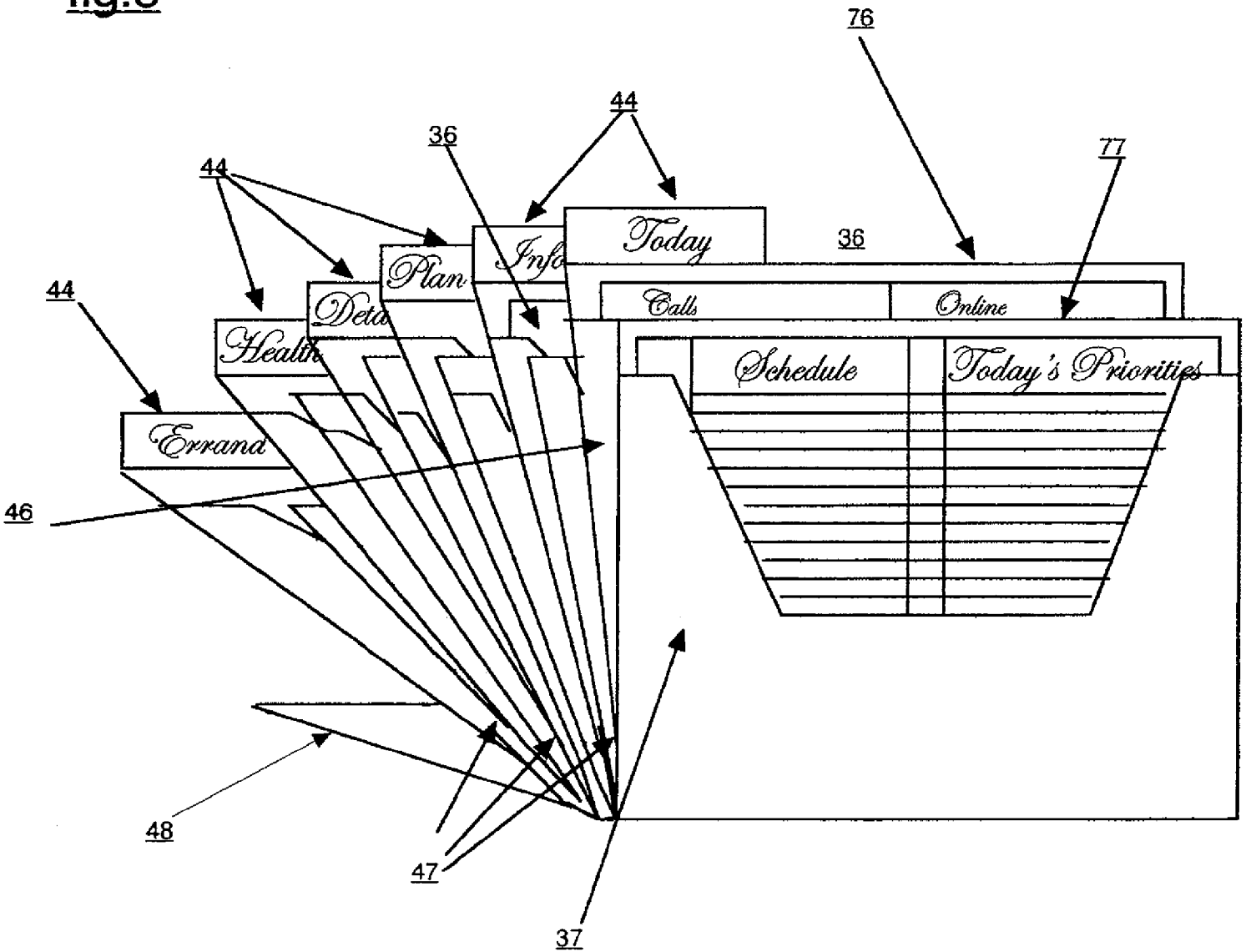
FIG. 5 is a side perspective view of a plurality of card holders with cards inserted therein.

A complete set of envelopes 37, with cards 36 inserted therein, is shown in FIG. 5. The cards are bound together with a flap 48 which inserts into the case 11 at opening 39. In this embodiment, there are six tabbed sections of envelopes, with two envelopes in each section. In each section (e.g. "Today") there is a front envelope and a rear envelope 46. It should be noted that the lower edge 47 of the rear envelope is attached to the front envelope at some vertical distance above the lower edge of the front envelope. This may be viewed as a two-tiered arrangement of envelopes in each section, with top edge 76 of the second or rear tier above the top edge 77 of the first or front tier. Accordingly, in a given tabbed section the upper portion of the card in the rear-tier envelope is immediately visible. As shown in FIG. 5, the section labeled "Today" has two cards: the front card has columns marked "Schedule" and "Today's Priorities" and the rear card has columns marked "Calls" and "Online."

Figure 6:
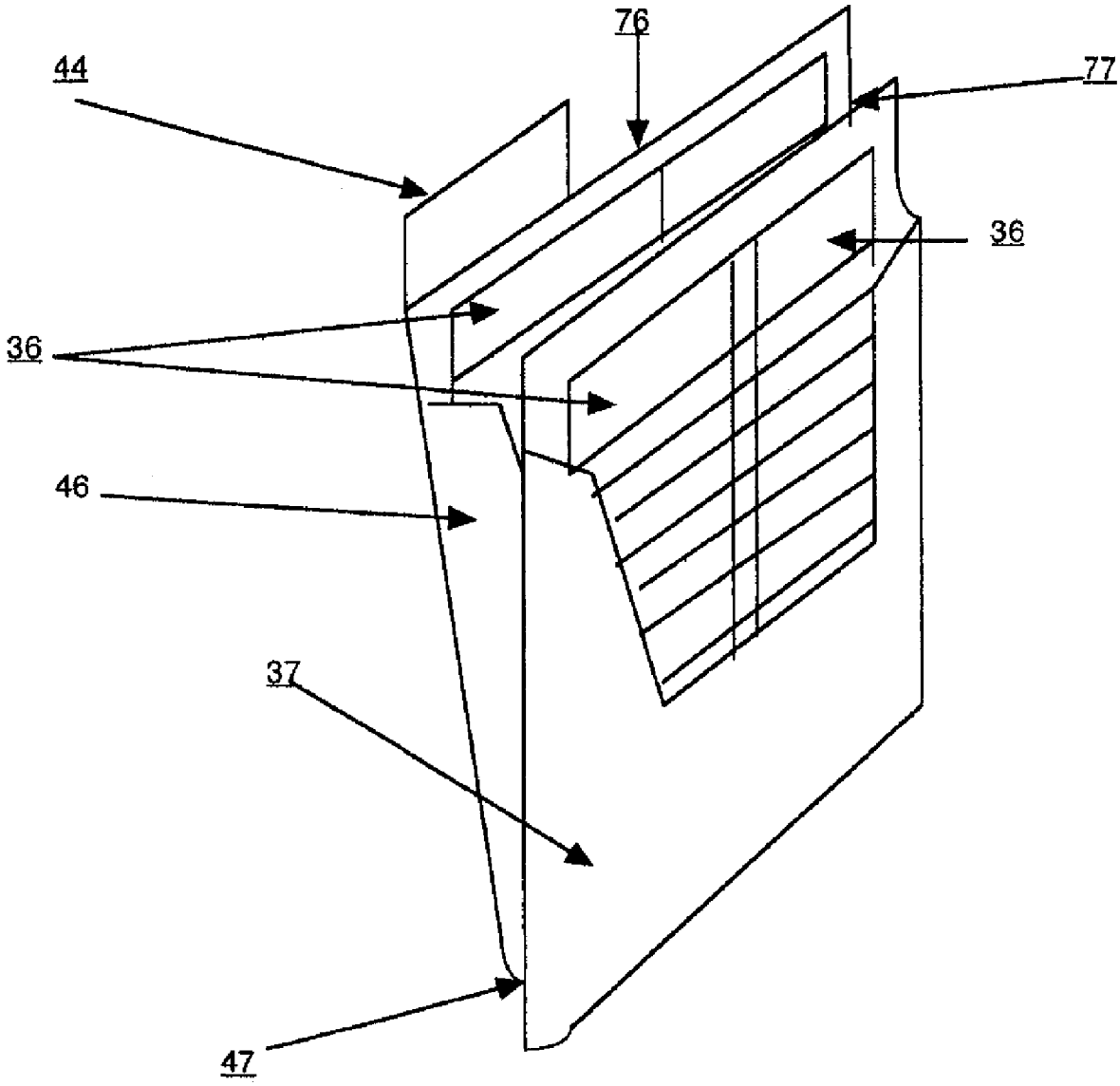
FIG. 6 is a side perspective view of a two-tiered card holder in accordance with an embodiment of the invention.

Details of the construction of a two-tiered section of envelopes, in accordance with this embodiment, are shown in FIG. 6. The lower edge 47 of rear envelope 46 is attached to the rear surface 75 of the front envelope; the rear (second tier) envelope is displaced vertically with respect to the front (first tier) envelope, so that an upper portion of a card inserted in the rear envelope is visible above the top edge 77 of the front envelope. Tab 44, attached to the rear envelope at the rear surface 50 thereof, extends above the top edge 76 of the rear envelope and is marked with a label identifying the section. As shown in FIG. 6, the rear envelope 46 is capable of movement with respect to the front envelope by rotating about the lower edge 47 of the rear envelope. In addition, as shown in FIG. 6, one or both of the two envelopes may have a cutout in the front surface thereof, to make the cards more immediately readable. The envelopes may be paper, vinyl or some other material; in particular, the vinyl may be clear, translucent or opaque as desired.

Figure 7:
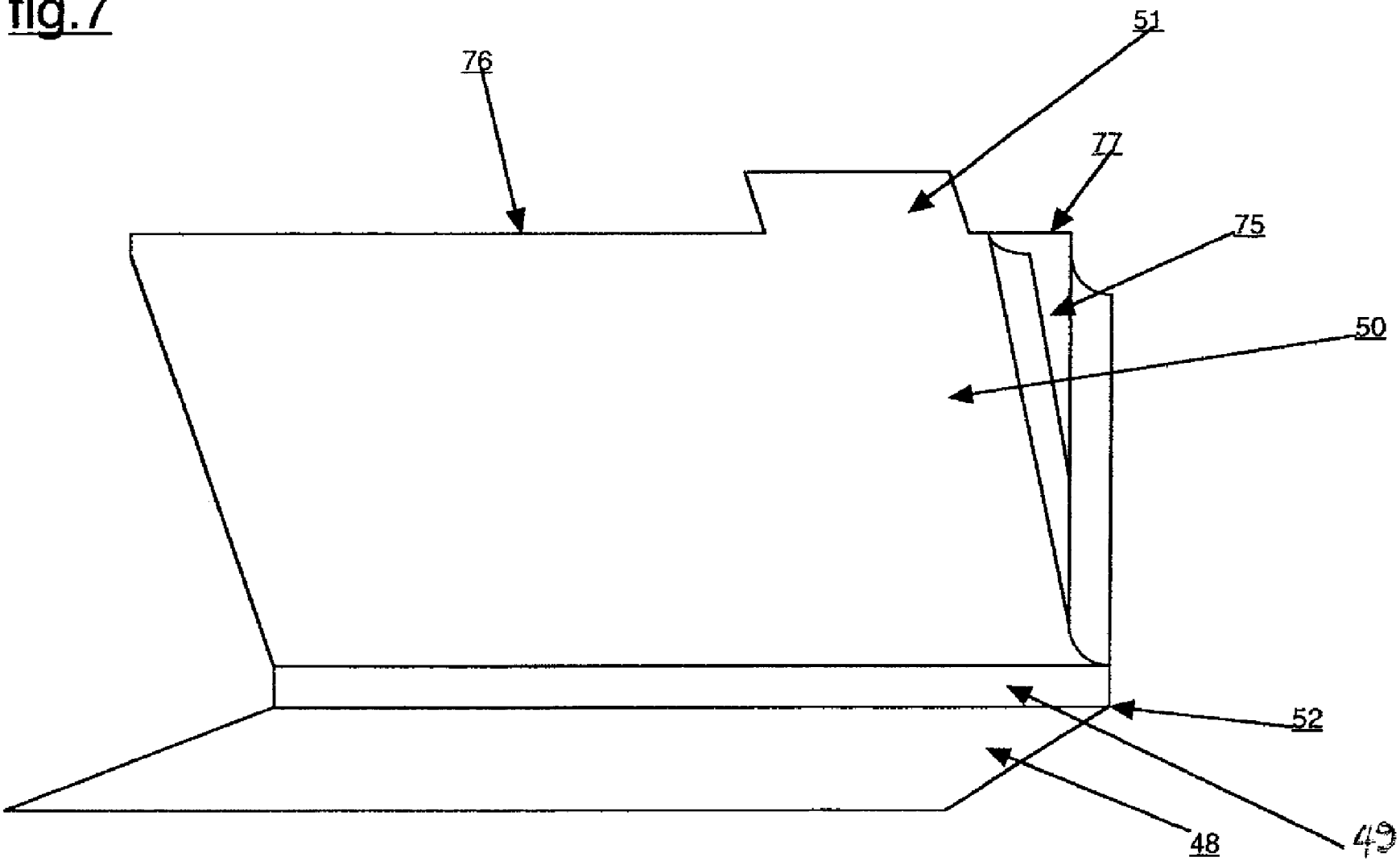
FIG. 7 is a rear view of the card holder of FIG. 6.

FIG. 7 is a rear view of a two-tiered section of envelopes. The rear envelope may be formed with an extended tab portion 51 for labeling the section, or the tab and label may be provided separately and attached to the envelope. The vertical displacement between the lower edge of the rear envelope and the lower edge 52 of the front envelope forms an edge portion 49. It should be noted that the envelopes are secured (bound, glued, etc.) only along their respective lower edges, so that the cards in each section may be individually viewed by simply flipping them forward.

In this embodiment, each section of the organizer has two tiers of envelopes. It will be appreciated that additional tiers of envelopes may be added to each section. In other embodiments, a section of envelopes may have only one tier. Furthermore, additional sections of envelopes for more categories of information may be provided.

It will be appreciated that in this embodiment, all of the envelopes accept the same size of card. It is possible, though much less convenient, to bind all of the envelopes together with their lower edges coinciding, and provide a two-tiered arrangement by using cards of different sizes with the rearmost card in each section taller than the cards in front.

Figure 8:
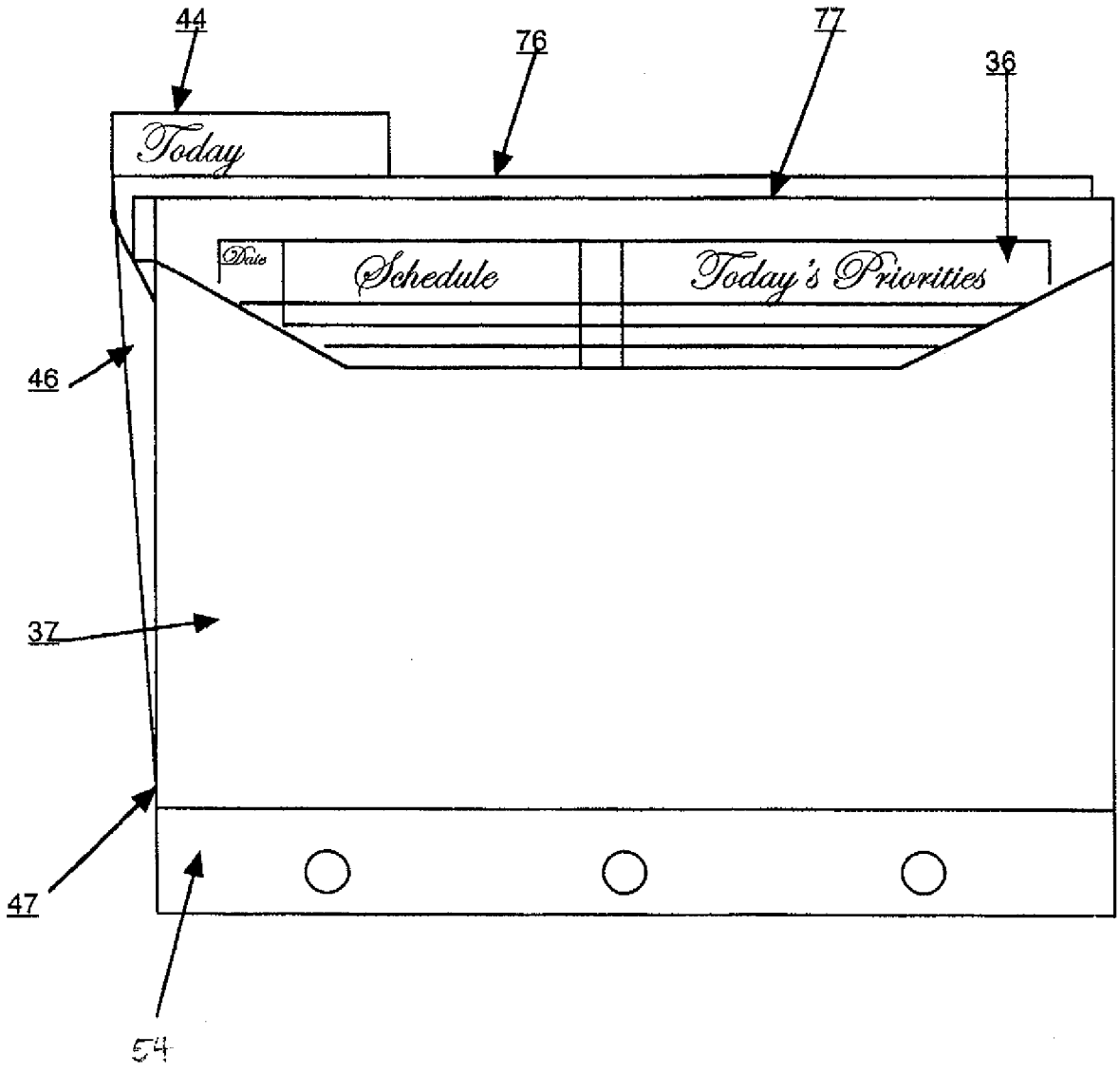
FIG. 8 is a front view of a card holder for use in a ring-binder case, in accordance with another embodiment of the invention.

A section of envelopes in accordance with an alternative embodiment of the invention is shown in FIG. 8. A strip 54 of material suitable for insertion in a ring binder is attached to the lower edge of the front (first or lowest tier) envelope. Any section, or group of sections, of envelopes may then be used in an outer ring-binder case. Since all of the envelopes are bound together in a unit (see FIG. 5), one strip 54 may likewise serve to hold all of the envelopes in a ring binder case. Cards 36 may then be inserted and removed from the envelopes as in the previously described embodiment. A ring binder mechanism may be provided in the hinge portion of the case 11.

Figure 9:
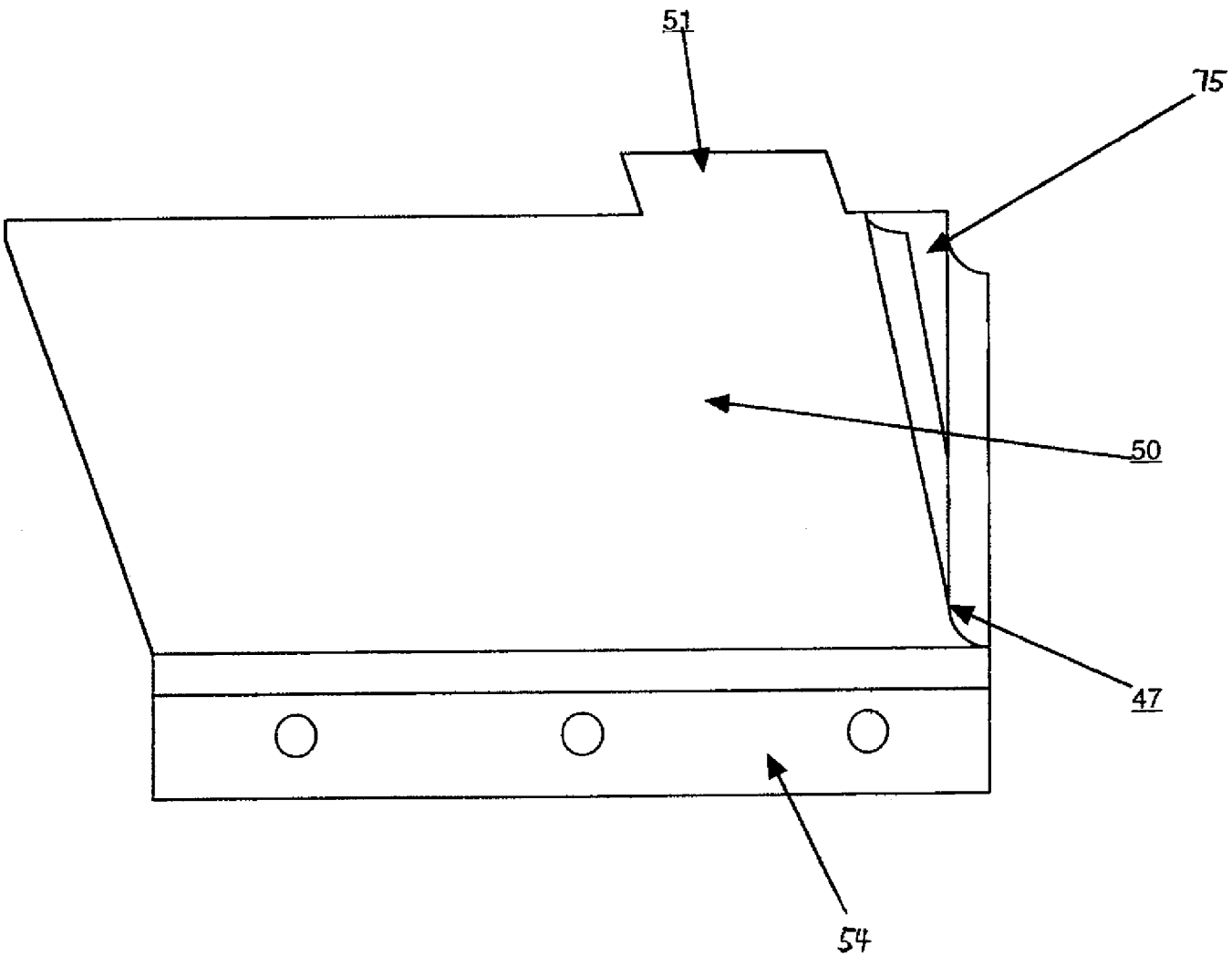
FIG. 9 is a rear view of a two-tiered card holder for use in a ring-binder case, in accordance with another embodiment of the invention.

FIG. 9 is a rear view of a two-tiered section of envelopes according to the embodiment of FIG. 8. Since the outer case includes a ring binder, flap 48 is replaced in this embodiment by strip 54 which is held by the ring binder (compare FIG. 7).

Figure 10A:
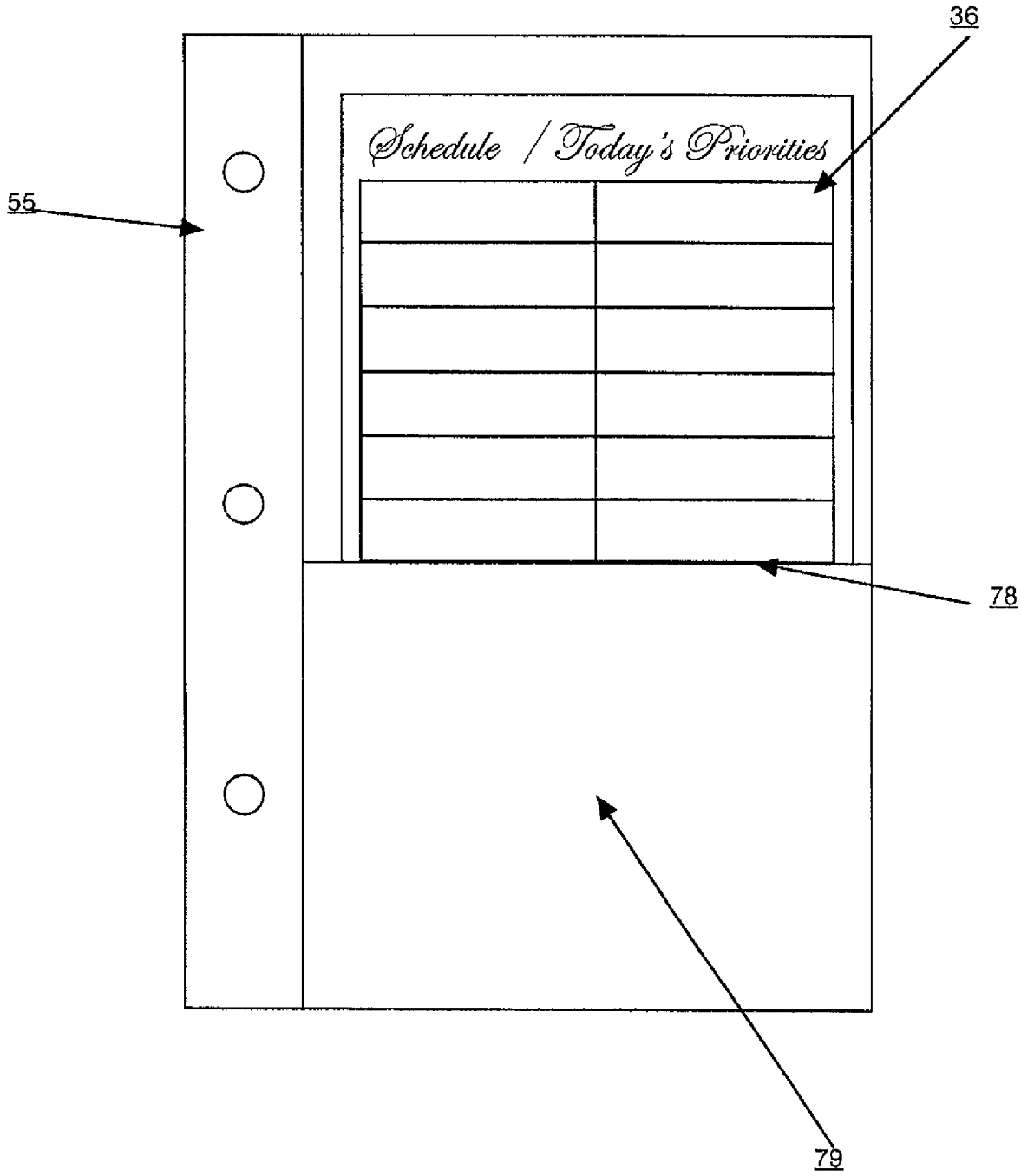
FIGS. 10A and 10B are front views of a card holder for holding cards vertically in a ring-binder case, in accordance with further embodiments of the invention.
Figure 10B:
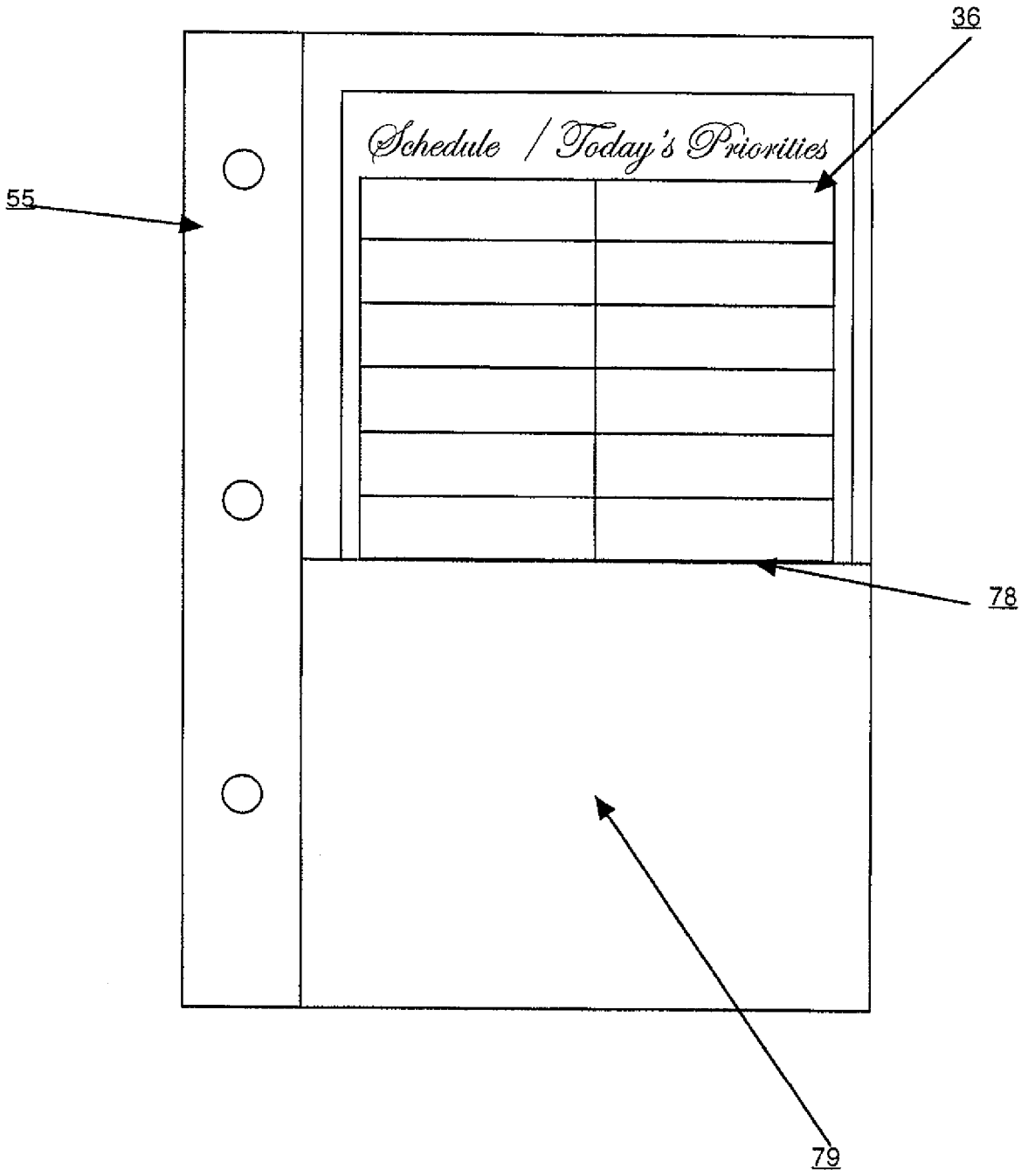

FIG. 10A illustrates another embodiment of the invention, in which an envelope 79 has a pocket 78 for holding a card or cards in a vertical orientation, with a strip 55 along the side for insertion in a ring binder. The outer edge of the envelope may have a tab with a label added thereto, as described above. As in the first embodiment, the envelope may be tiered; that is, the envelope may be provided with two pockets with the rear pocket shallower than the front pocket. Accordingly, the upper portion of a card in the rear pocket may be visible above and behind the card in the front pocket, as shown in FIG. 10B.

FIGS. 11A-11C, 12A and 12B illustrate templates for forming a portion of an organizer according to one embodiment, using paper, cloth, vinyl or some other suitable material.

Figure 11A:
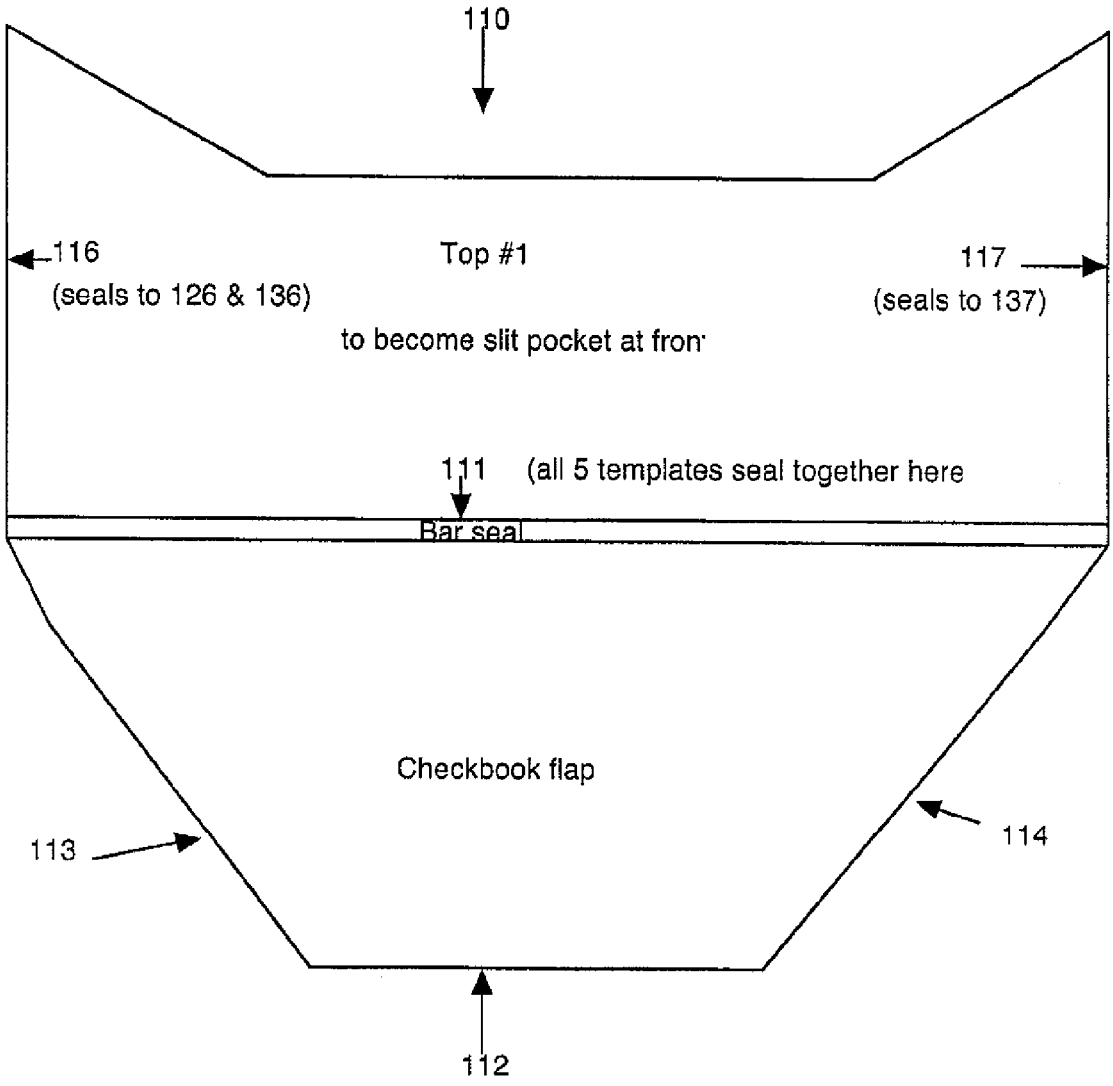
FIGS. 11A-11C, 12A and 12B are templates for card holders and dividers for a checkbook-style organizer, in accordance with an embodiment of the invention.
Figure 11B:
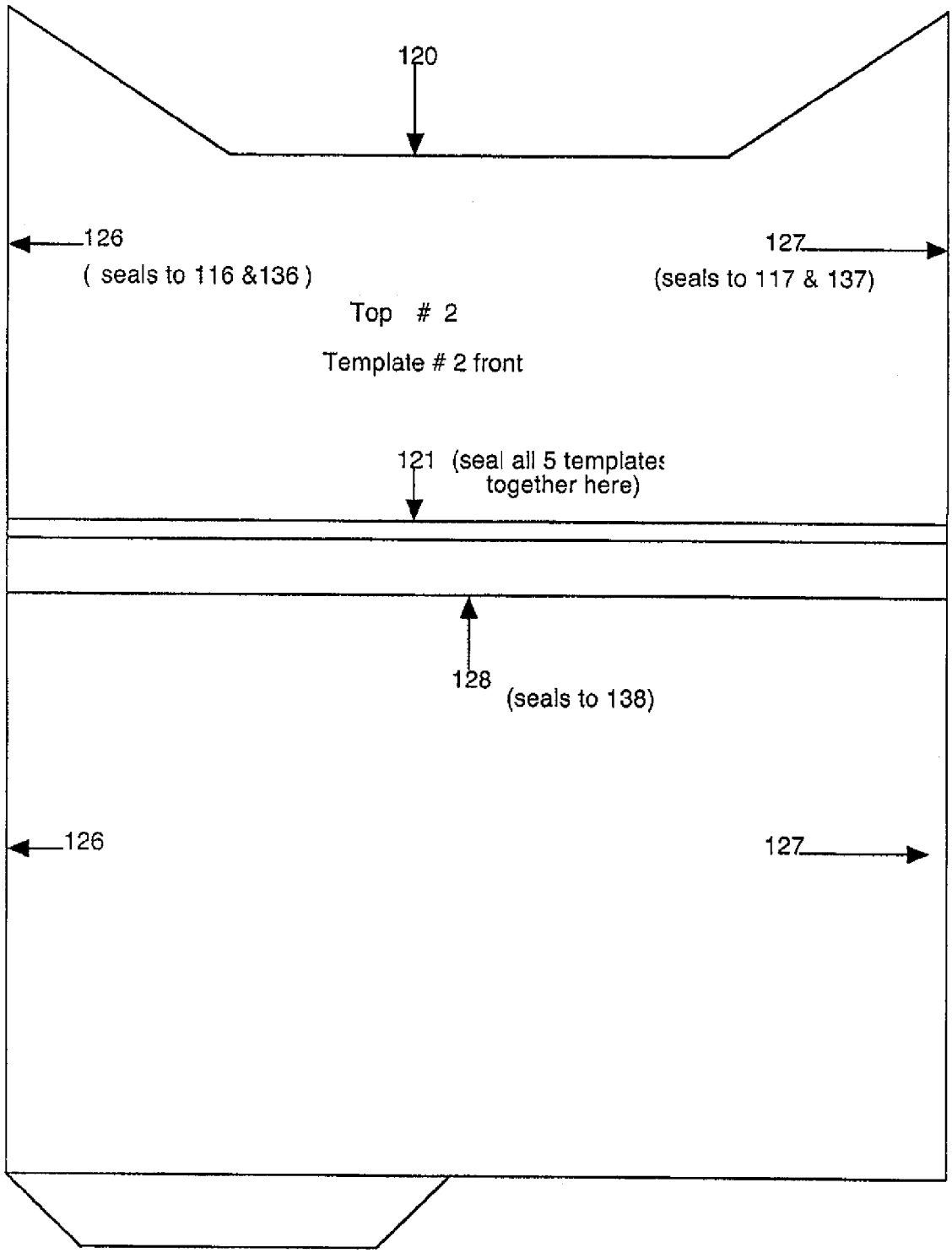
Figure 11C:
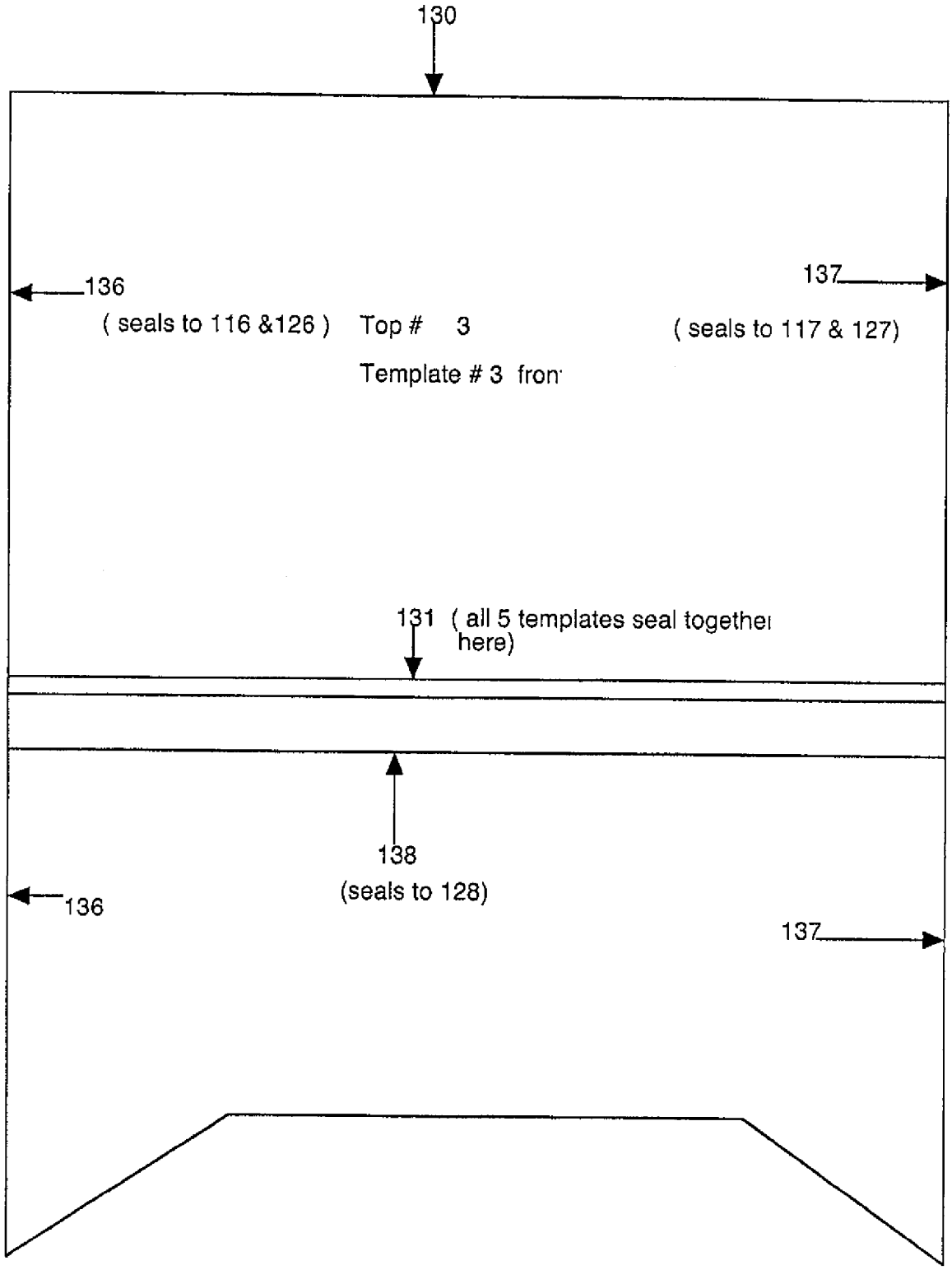

The templates of FIGS. 11A, 11B, and 11C are used to construct a first unit in a series of two units which together will become one set of four envelope sections (with one front section for holding a business card or the like). Shape 120 (FIG. 11B) is placed on top of shape 130 (FIG. 11C) and the shapes are then sealed together along lines 128 and 138 by any convenient method. If the envelopes are made of vinyl, the sealing is preferably done by a heat-sealing process. Shape 110 (FIG. 11A) is then placed on top of shape 120, which in turn is on top of shape 130 (shapes 120 and 130 being sealed at lines 128 and 138.

Figure 12A:
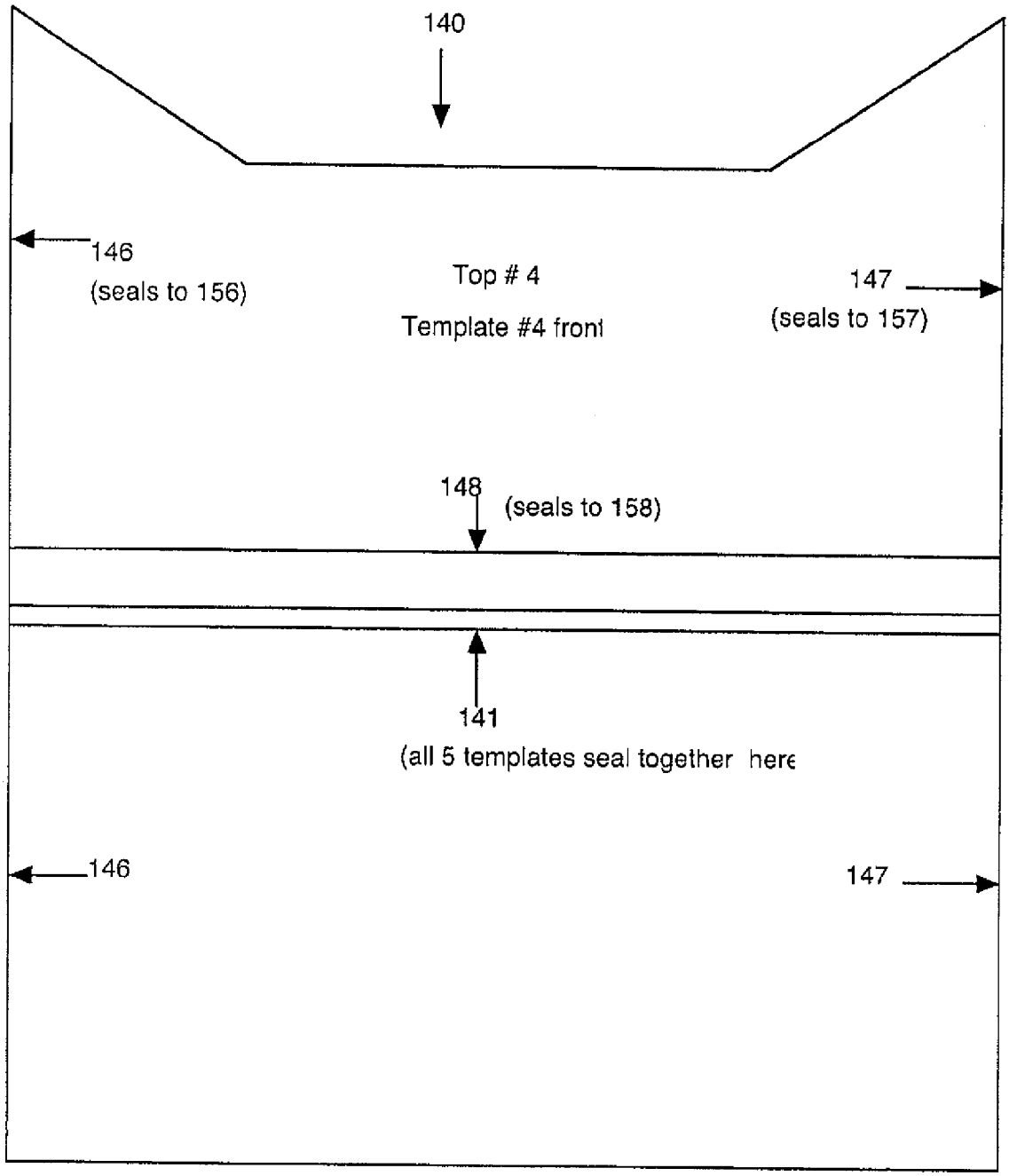
Figure 12B:
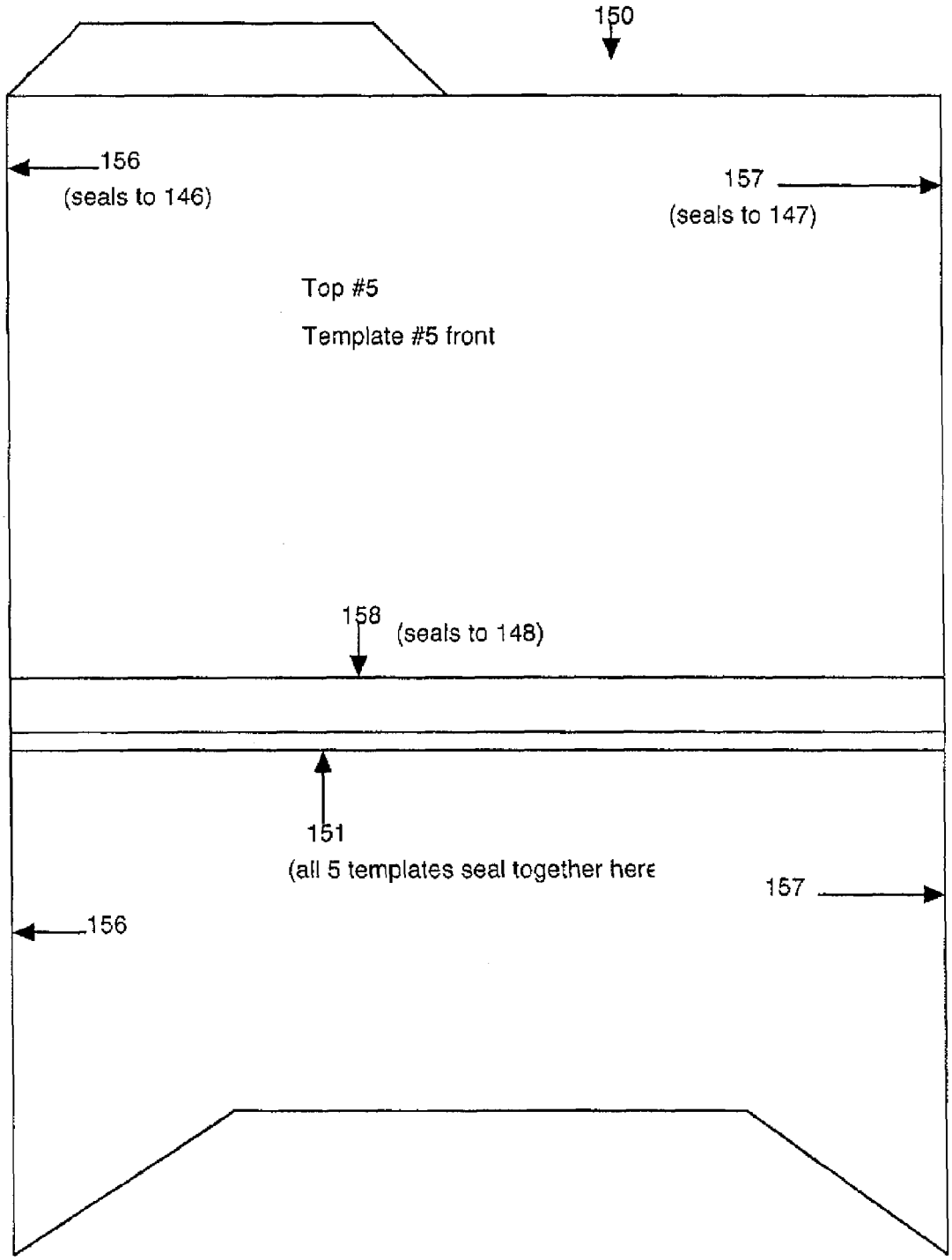

The edges of the three shapes are then sealed together along 116, 126, and 136 on one side, and respectively along 117, 127 and 137 on the other side. The templates of FIGS. 12A and 12B are used to construct a second unit in a series of two units. Shape 140 is placed on top of shape 150. The shapes are then sealed together along lines 148 and 158, and also along edges 146 and 156 on one side and respectively along edges 147 and 157 on the other side.

The first unit (which includes 110, 120 and 130 sealed together) is placed on top of the second unit (which includes 140 and 150 sealed together). These two units are then sealed together along lines 111, 121, 131, 141 and 151 to form a single unit having four envelope pockets and one front section for holding a business card or the like, with a checkbook style flap at the rear.

Figure 13:
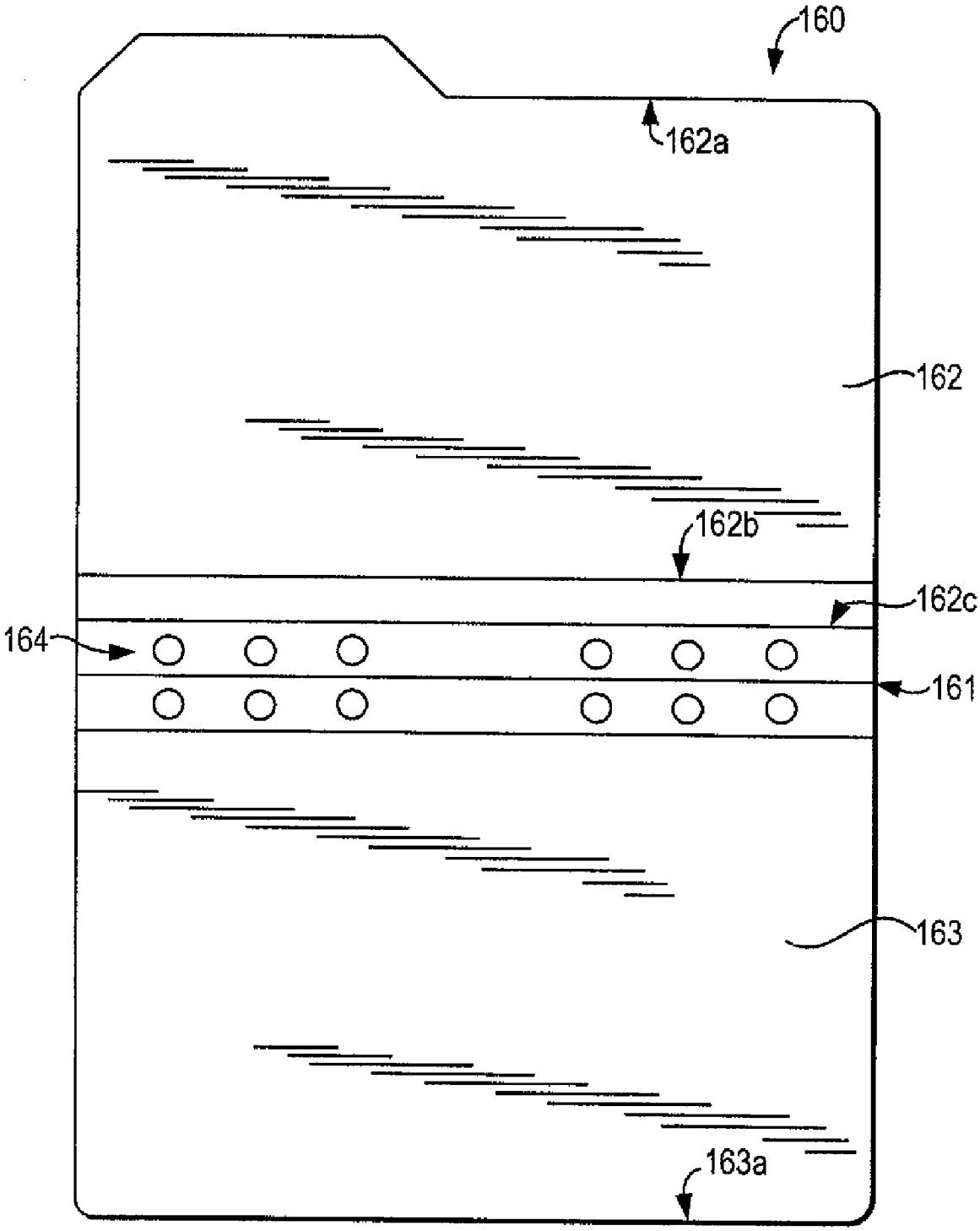
FIG. 13 is a template for a tabbed card holder for a ring-binder style organizer, in accordance with another embodiment of the invention.

FIG. 13 illustrates a template for forming a section of two envelopes for holding cards where the sections are placed in a ring binder, according to another embodiment of the invention. (As noted above, the ring binder may be placed in the center section of case 11.) Shape 160 is initially formed of vinyl, but may be formed of another material. It should be noted that, when shape 160 is folded along line 161, the edges

162*a* and 163*a* of portions 162 and 163 do not meet. Accordingly, if portions 162 and 163 respectively are formed into pockets (envelopes) for cards (the envelopes having openings along edges 162*a* and 163*a* respectively), a card in portion 162 will extend vertically from 162*a* to 162*b* and will thus be visible (at least at its upper edge) behind a card in portion 163, even though the envelopes are substantially the same depth and the cards are substantially the same size. This permits greater accessibility of all the cards and makes the organizer easy to use.

As shown in FIG. 13, a set of two envelopes, including an attached tab, may conveniently be formed in one piece having two sets of ring binder holes. When the piece is folded along line 161 (which runs between the two sets of holes), the sets of holes coincide and are thus suitable for insertion into a ring binder. An envelope formed from portion 163 then becomes the front envelope of the set, and an envelope formed from portion 162 becomes the rear envelope. Since the bottom edge 162*b* of the rear envelope is displaced from the portion 164 having the holes, the rear envelope will be displaced vertically above the front envelope. The region between line 162*b* (that is, the bottom of the envelope in portion 162) and line 162*c* (the edge of hole portion 164) may be viewed as a closed edge portion which provides the vertical displacement between the envelopes and the respective cards.

A detailed description of six categories of information which may be organized using an embodiment of the invention, together with possible methods of handling the information for increased personal effectiveness and productivity, is given below.

In one system for organizing information embodying the invention, the user may pick and choose those categories which s/he finds most useful. In another system embodying the invention, a set of categories is developed for the user in accordance with the individual's needs and preferences. The organizer may thus be personalized for the individual user; the user can also personalize aspects of the categories. Furthermore, the user may change any preprinted content different aspects of each card to suit individual needs. In this embodiment, the cards contain helpful prompts in addition to the category; each category of information contains a prompt pertaining to that particular topic, so as to make the card user-friendly. The prompt provokes the user of the organizer to make use of the card and system more effectively, thereby making the user more productive and fulfilled.

The prompt also serves as a form of instruction for the use of the system. For example, the user may change the prompt on the To Do and Project List card from, "Avoid forgetting things! . . . " to "Write it so it won't be forgotten!" The user can also create entirely new categories that are geared to that person's specific needs and interests.

A system including six categories of information is described more fully below. Those skilled in the art will appreciate that this is an example, and that a system according to the invention is not limited to a specific number of categories or subcategories. Besides the categories discussed herein, it will be appreciated that a very wide variety of possible categories and combinations thereof may be used.

The six categories of information in this example are as follows:

1) Today

The first category, labeled "Today," includes two subcategories: Schedule/Today's Priorities and Calls/Online. In this embodiment, the prompt for Schedule is "Review your calendar." The prompt for Today's Priorities is "Review all sections of your system." The prompt for Calls is "record all calls you need to make here." The prompt for Online is "To-do list for the Internet." As described above, information pertaining to each is on a separate card, at least portions of which are both visible when the organizer is opened to the "Today" tab. The "Today" category thus has a section of cards corresponding thereto, with at least one card corresponding to each subcategory.

Schedule/Today's Priorities: This card is used to record in detail the events of the current day. At the beginning of each day or prior evening, the user transposes all information from the monthly calendar (e.g. calendar 42 in the lower portion of the organizer) to that specific day's Schedule card. The user then reviews all of the various sections of the organizer, and records the priorities for that specific day in the "Today's Priorities" portion of this card. This provides a more active system of accessing and planning a time schedule than typical day planners. It allows the user to have a simple visual cue for the entire day and easy access to other details that are needed for current use.

Each day, the user reviews the following sections of this embodiment of the organizer: Today, Information, Planning, Details, Health and Errands (and/or other sections in accordance with a personalized organizer as mentioned above). For example, in reviewing the Today section, the Calls card would need to be reviewed in preparing Today's Priorities on the Schedule card. Another example would be in reviewing the Planning section, if one of the goals is to lose ten pounds, the user is then prompted to review the schedule and priorities for the day to determine if anything will be done toward that particular goal. (For example, is there anything in the current day's Schedule and Priorities card to serve as a reminder and an aid to achieve the weight loss goal, such as exercising or avoiding eating after dinner?) As another example, if the user finds that the next step of a project is to call a particular person, the user then decides whether the call should be done on that specific day. The user will also transpose, if desired, priorities not completed from the prior day. Alternatively, the user may decide to transpose incomplete items and/or unfinished tasks to the specific section of the organizer to which it belongs. For example, an errand not completed on that day may go to the Errands section if it cannot be done on the next day. Alternatively, it can be eliminated if the user determines that it no longer needs to be done.

The user may choose to insert several of the Schedule/Today's Priorities cards so as to cover a longer time period (e.g. seven cards for one week). It should be noted, however, that only one card need be actually carried (such as a Schedule card or Shopping card). These cards may be easily removed from the organizer case and placed back when the user returns. Although the system is very effective when used in this fashion, the effectiveness of the entire system is optimized when a user carries the case with all the envelope sections, A user who has accomplished everything noted on a card may simply discard it, or file it in a "Filing Vault" or another filing system.

Calls/Online: This card is the second section of the Today category. It is used to record all the telephone calls and online activities that the user needs to do. If the user determines that a call needs to be made, a judgment must then be made whether to make the call at that moment, record it on Today's Priorities, or record it on the Calls card. The user will determine if the telephone number of that call will be frequently used, in which case the number is recorded on the Frequently Used Phone Numbers card. Phone numbers written on note card 38, on miscellaneous Post-its® or other pieces of paper are to be recorded on the Calls card and/or on the Frequently Used Phone Numbers card. The miscellaneous and random pieces of paper can then be discarded.

As a user determines that something needs to be done online, a judgment is likewise needed whether it can be done at that moment, recorded on Today's Priorities, or recorded on the Online section of the Calls card. The Calls/Online card needs to be reviewed in preparing Today's Priorities on the Schedule card. Anything needed to be done on the computer is recorded on the Online portion of this card. Thus, the user can see on one card all the calls that need to be placed and all the activities that need to be done on the computer, so that he/she can be optimally efficient when there is time to use the telephone or the computer.

2) Information

The Information category has two subdivisions: Frequently Used Phone Numbers and Current Information, each of which in this embodiment has a separate card. The prompt for the Current Information card is "Use a Current Information card to record schedules, activities and other events."

Frequently Used Phone Numbers: The user will refer to this card to quickly access the phone numbers and emails that are most active in their present day-to-day life. If the user receives a business card, s/he will decide whether to record the number on the Frequently Used Phone Numbers card. The business card can then be discarded or saved with other business cards in a separate location. In contrast to the Frequently Used Phone Numbers card in this embodiment, a typical phonebook section of a day planner generally holds a person's entire phonebook. This is far more information than a person needs to carry around on a given day.

Current Information: Individual cards in this section detail current information, such as specific time schedules pertaining to a person's activities; one card might be for school or store hours, one card might be for the schedules of a child's after-school activities, etc. A Current Information card is particularly useful because the information collected on that card is generally used only for a limited time period, such as a semester, a season, a school year or a business quarter. The user records details of schedules, activities and other events on individual Current Information cards. For example, a user might have one card to record the dates of pre-paid private exercise training to keep track of usage. During the course of a given day, it may be necessary to refer to a particular Current Information card. The user may need to check a schedule to see if an upcoming appointment will conflict with an ongoing activity. The Current Information cards thus serve as a unique personal reference, so that the user is more efficient and effective, and feels more organized.

3) Planning

The Planning category includes two subdivisions: To-Do/Project List and Goals/Ideas. The prompt for the To-Do/Project card is "Avoid forgetting things! This is your list of all the things you need to do. Keep track of projects and to-do details on individual Project and Contact Cards in the Details Section." The prompt for the Goals section is "Make a decision and act on one of your goals." The prompt for the Ideas section is "Great ideas go here, so your will not forget them." Each of these subdivisions has a card associated therewith.

To-Do/Project List: This section encompasses all of the activities the user wishes to accomplish. By keeping this section current, the user gains assurance that an important task will not be forgotten. Further details should be developed in the following category, "Details," which holds Project and Contact cards.

Goals/Ideas: The user records what s/he wants to achieve under "Goals." Studies have shown that a person who writes down goals and reviews them frequently is much more likely to act on them and to achieve them. Examples of goals are: lose ten pounds, be more patient, write a novel, learn a new language, etc. The user records thoughts and observations under "Ideas." The Ideas section is a place to hold those thoughts that might slip from one's mind. In this embodiment, the Ideas section provides a place to record anything the user wants to remember, instead of writing on stray pieces of paper or relying on memory. These ideas can then be transferred to the Goals section, the To-do list, or to a Project or Contact card.

4) Details

The Details category includes two subdivisions: Projects and Contacts. The prompt for the Contact Card is "Keep track of information related to this person." The prompt for the Project card is "Keep track of project details here."

Projects: The user writes details of "projects" just begun or in progress on a specific Project card. A project could be as large as an event containing many details or as small as simply a place to keep a price comparison while shopping for an item. The user will keep track of pertinent information related to a project on an individual Project card. This card will contain information that the user might need to carry separately from the organizer 10, or simply held within a pocket or envelope 37 of the organizer for easy reference when needed. This card thus may be regarded as the beginning of what could become a formal file. It will help the user remember what is the next step to be done in a project, as well as to provide information needed for that project. The Project section of the organizer in this embodiment thus allows easy access to details for further action, follow-up or reference, in or out of the office.

Contacts: The second subdivision the Details category is a Contact card. This differs from the Project card in that it is specific to a person. Pertinent information related to a person will be recorded on an individual "Contact" card. For example, the user may have a conversation with a physician, teacher or attorney and while doing so, may want to jot down notes pertaining to the immediate conversation. As another example, the user may want to have a Contact card for his/her supervisor to provide one place to keep notes to discuss at the next meeting. The cards in the Contact section of the organizer then become a place of reference for further conversations or follow-up. These cards allow the user to take notes in a more organized and meaningful manner than the typical writing down of notes on stray pieces of paper or notepads.

5) Health

The fifth section of the organizer in this embodiment relates to the Health category. This category includes two subdivisions: Food Log and Exercise/Personal Monitor Log. It will be appreciated that this is an important category for organizing and balancing one's life. The user needs to keep track and monitor several health-related issues, including diet and exercise. The Health section of the organizer may be used to accomplish and track personal health goals.

Food Log: A card in the Health section is used to record food and beverage consumption, as well as weight, on a weekly basis. This food log will help the user monitor the progress of a diet plan. Studies have shown that an important key to weight loss success and overall health is the writing down of all food consumed on a daily basis and weight on a daily or weekly basis. The Food Log card is always available in the organizer, so it is easy to remove and quickly record food consumed during the day. By having a specific card available for more detailed aspects of one's life (in this case, one's diet), the details are less likely to be overlooked or forgotten. It is noteworthy that a person who is not used to writing down all these details or is having difficulty getting started, and makes an attempt that is not successful, may simply throw away the card and start again with a fresh card, or save a successful card for further inspiration. In this regard, an organizer according to the invention offers an advantage over permanently bound calendars or journals; "failures" no longer loom large in a permanent book or binder. Every week or day can be a new beginning to get back on track.

Exercise/Personal Monitor Log: A card in this subdivision is used to keep track of physical activity and monitor any personal or health issues. Physical activity could include a wide variety of activities, from a yoga class to a brisk walk. A few examples of issues to be monitored include blood pressure, blood sugar levels, heart rate, etc. In addition, the user may wish to monitor a beauty/grooming regimen; e.g. manicure, hair color, waxing, etc.

6) Errands

A sixth section of the organizer holds shopping lists, errand lists and other items. One subdivision of this section has a card (a "Groceries/stores/errands" card) which may have a grocery list, and in addition may be organized according to different stores. Thus, the user is able to target the specific items needed at a certain store. This will make day-to day travels more efficient. For example, suppose that a user unexpectedly has some time for shopping and passes by a drugstore. The user takes the 'drugstore' card out of the Shopping section of the organizer; items needed at the drugstore are already recorded thereon. The user thus no longer has to rely on memory for what is needed at that store. Similarly, errands (e.g. shoemaker, tailor, bank, dry cleaners, etc.) are recorded on another section of this card; errands will be done more efficiently because they have previously been entered on the Errands section of the card.

Another envelope or holder in this section is labeled "A Place For." This is a place for holding pieces of paper that have value which will be needed outside the home or office, such as receipts, prescriptions, coupons, bank deposits, and lottery tickets.

In addition to any or all of the above six categories, the user can create an entirely new category with customized topics and prompts. For example, a user who is a golfer may create a Golf category. The topics may include best golf courses, scores at courses, new clubs to shop for, details of golf partners, etc. These to be assisted with a prompt created by the user, such as "Ways to beat Fred" or "I will golf better if I had these."

As described in detail above, the organizer may be constructed in a checkbook style and a ring binder style; other configurations are possible as will be understood by those skilled in the art. The multi-tiered (in these embodiments two-tiered) arrangement of the envelopes ensures easy access to cards placed therein. It is noteworthy that the contents of the envelopes (cards in the embodiments discussed above) are disposable and/or filable, so that the contents of the organizer may be replaced and refreshed whenever desired. It will be appreciated that an organizer according to the invention need not contain large quantities of obsolete information, as commonly is the case with traditional planners. A user may discard that which is no longer relevant, such as a shopping list or a completed to-do list. The cards, labeled and marked (for example) as shown in FIGS. 5 and 6, may be made of various card or text weight paper, and may be preprinted or prepared on a user's computer printer with appropriate software.

Furthermore, as discussed above, the categories of information (corresponding to sections of cards) provide a tool for managing many different aspects of the user's professional and business life. The organizer may thus be viewed as an integrated system which enables the user to easily access, record and monitor his/her priorities, ensuring that the user recognizes and accomplishes that which is considered most important.

While the invention has been described in terms of specific embodiments, it is evident in view of the foregoing description that numerous alternatives, modifications and variations will be apparent to those skilled in the art. Accordingly, the invention is intended to encompass all such alternatives, modifications and variations which fall within the scope and spirit of the invention and the following claims.

We claim:

1. An article of manufacture comprising:

a first envelope having an open first edge and a closed second edge opposite the open first edge;

a first hole portion adjacent the second edge, the first hole portion having holes therein arranged substantially parallel to the second edge;

a second hole portion adjacent the first hole portion and contiguous therewith along a dividing line, the second hole portion having holes therein arranged substantially parallel to the holes of the first hole portion;

a closed edge portion adjacent the second hole portion and contiguous therewith along a line parallel to the dividing line, the closed edge portion having a length extending along a length of the second hole portion; and a second envelope having a closed first edge and an open second edge opposite the closed first edge, the closed first edge being adjacent to the closed edge portion, wherein the closed edge portion has a width separating the second envelope from the second hole portion.

2. An article of manufacture according to claim 1, wherein said article is adapted for insertion into a ring binder by folding along the dividing line.

3. An article of manufacture according to claim 1, wherein the first envelope has a first depth given by a distance from the open first edge and the closed second edge thereof, and the second envelope has a second depth given by a distance from the closed first edge and the open second edge thereof, and the first depth and the second depth are substantially equal.

4. An article of manufacture according to claim 1, further comprising a tab extending from the second envelope.

* * * * *